US011045680B2

(12) United States Patent
Henesey

(10) Patent No.: US 11,045,680 B2
(45) Date of Patent: Jun. 29, 2021

(54) FREE WEIGHT EXERCISE SWING ATTACHMENT

(71) Applicant: Brian P. Henesey, Lansdale, PA (US)

(72) Inventor: Brian P. Henesey, Lansdale, PA (US)

( * ) Notice: Subject to any disclaimer, the term of this patent is extended or adjusted under 35 U.S.C. 154(b) by 0 days.

(21) Appl. No.: 16/352,299

(22) Filed: Mar. 13, 2019

(65) Prior Publication Data

US 2019/0282845 A1 Sep. 19, 2019

Related U.S. Application Data

(60) Provisional application No. 62/643,006, filed on Mar. 14, 2018.

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 21/072*** | (2006.01) |

(52) U.S. Cl.

CPC ..... *A63B 21/0407* (2013.01); *A63B 21/0004* (2013.01); *A63B 21/0555* (2013.01); *A63B 21/0724* (2013.01); *A63B 21/0726* (2013.01); *A63B 21/4034* (2015.10); *A63B 21/4035* (2015.10)

(58) Field of Classification Search

CPC ..... A63B 21/0407; A63B 21/0004; A63B 21/0555; A63B 21/0726; A63B 21/4035; A63B 21/4034; A63B 21/0724; A63B 21/151; A63B 21/00043; A63B 21/04; A63B 21/0421; A63B 21/0435; A63B 21/0442; A63B 21/072–08; A63B 21/15–151; A63B 23/047; A63B 23/04–0429; A63B 2244/09

See application file for complete search history.

(56) References Cited

U.S. PATENT DOCUMENTS

| | | | | |
|---|---|---|---|---|
| 4,216,959 A * | 8/1980 | Niles | A63B 21/078 24/299 |
| 4,527,797 A * | 7/1985 | Slade, Jr. | A63B 21/0626 482/101 |
| 5,209,712 A * | 5/1993 | Ferri | A61H 1/02 482/131 |
| 7,044,896 B2 | 5/2006 | Hetrick | |
| 7,090,622 B2 | 8/2006 | Hetrick | |
| 7,255,666 B2 * | 8/2007 | Cardenas | A61H 1/0229 482/143 |

(Continued)

OTHER PUBLICATIONS

International Search Report and Written Opinion dated May 1, 2019 in International Application No. PCT/US2019/022058.

(Continued)

*Primary Examiner* — Megan Anderson
*Assistant Examiner* — Kathleen Vermillera
(74) *Attorney, Agent, or Firm* — Stroock & Stroock & Lavan LLP

(57) ABSTRACT

An exercise apparatus including two straps where each strap includes a first end and a length. The first end being configured to be received by a supporting structure. Each strap including a plurality of loops along its length where each loop is sized and configured to removably support a free weight. The straps and placement of the free weight allowing a user to perform various exercises in a horizontal direction.

8 Claims, 15 Drawing Sheets

(56) References Cited

U.S. PATENT DOCUMENTS

| | | | | |
|---|---|---|---|---|
| 7,651,448 | B2 | 1/2010 | Hetrick | |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 7,909,748 | B2 * | 3/2011 | Calvagne | A63B 7/02 482/143 |
| 8,043,197 | B2 | 10/2011 | Hetrick | |
| 8,083,653 | B2 | 12/2011 | Hetrick | |
| D669,945 | S | 10/2012 | Russo et al. | |
| 8,469,864 | B2 | 6/2013 | Hetrick | |
| 8,628,059 | B2 | 1/2014 | Hetrick et al. | |
| D710,956 | S | 8/2014 | Hetrick et al. | |
| 8,840,532 | B2 | 9/2014 | Hetrick et al. | |
| 8,876,672 | B2 * | 11/2014 | Schiano | A63B 21/078 482/94 |
| 9,155,931 | B2 | 10/2015 | Hetrick | |
| 9,199,119 | B2 | 12/2015 | Hetrick et al. | |
| 9,427,622 | B2 * | 8/2016 | Thrasher-Rudd | A63B 21/4034 |
| 9,433,258 | B2 | 9/2016 | Hetrick et al. | |
| D831,764 | S | 10/2018 | Hetrick et al. | |
| D842,946 | S | 3/2019 | Hetrick et al. | |
| 10,245,460 | B2 | 4/2019 | Hetrick et al. | |
| 10,675,501 | B2 * | 6/2020 | Vorozilchak | A63B 21/1681 |
| 10,857,413 | B2 | 12/2020 | Hetrick et al. | |
| 2010/0113235 | A1 | 5/2010 | Calvagne et al. | |
| 2013/0165301 | A1 | 6/2013 | Thrasher-Rudd et al. | |
| 2014/0073493 | A1 * | 3/2014 | Parish | A63B 21/0783 482/104 |
| 2016/0287927 | A1 * | 10/2016 | Hunter | A63B 21/4035 |
| 2017/0127808 | A1 | 5/2017 | Conlin | |

OTHER PUBLICATIONS

Helping Athletes Reach Their Short Term Goals and Chase Their Long-Term Dreams!.OverAchieve Sports and Speed, LLC, 2010 [retrieved on Apr. 15, 2019]. Retrieved from the Internet: URL:https://www.overachievesportsandspeed.com/home.

* cited by examiner

FREE WEIGHT EXERCISE SWING ATTACHMENT

CROSS REFERENCE TO RELATED APPLICATIONS

The present application claims priority to and the benefit of the filing date of U.S. Provisional No. 62/643,006, filed Mar. 14, 2018, which application is incorporated herein fully by this reference.

FIELD OF THE INVENTION

The present invention relates generally to an exercising apparatus. More specifically, the present invention is a free weight exercise swing attachment apparatus suitable for standard power racks and other equipment.

BACKGROUND OF THE INVENTION

Current weight and cable machine equipment is forced into a fixed movement path that is dictated by the design of the machine. Free weight exercises are known to provide certain advantages for building athleticism and functional strength since they require more stabilization, coordination and balance. Functional strength is important for maintaining quality of life. Research continues to show a correlation between strength and morbidity rates among elderly populations. The free movement in all directions of free weights is also important for people working around old injuries. Machines that lock the user into a fixed movement path can aggravate pre-existing shoulder and back injuries because the lifter is forced into a path that does not fit their anatomy.

However, weight machines popularity is related to the convenience of them being easier to use for weight lifters since they require less control and are often pre-positioned in the desired starting and lifting positions so that the user can isolate certain muscle groups and not have to struggle to move the weight into the proper starting point.

Thus, a need exists for an improved device for building athleticism and functional strength.

SUMMARY

Embodiments of the present invention solve the foregoing and other needs. In one embodiment, an exercise apparatus comprises two straps. Each strap has a first end and a length. The first end is configured to be received by a supporting structure. The strap also comprises a plurality of loops along the length where each loop is designed and configured to removably support a free weight. In one embodiment the strap is formed by a plurality of loops interlocking together.

In one embodiment the straps are attached to a support by adjustable steel pins. In one embodiment, the strap is flexible and is comprised of nylon. In one embodiment the free weight is a barbell. In one embodiment multiple weights can be inserted in multiple straps.

In certain embodiments users utilize the exercise apparatus to carry out exercises. In one embodiment, the user flexes the free weight utilizing their foot. In one embodiment the user moves the weight with their hand(s). In another embodiment, the user can strap the free weight around their waist with a belt and strap.

One advantage of embodiments of the present invention is that they provide a middle ground between free weights and the fixed movement nature of machines for weight lifting. Although embodiments of the present invention provide some control throughout the range of movement, they still can allow for complete movement in all directions and in all planes.

Embodiments of the present invention allow freedom of movement, and also provide a more convenient way of getting the weight load into the desired lifting position than conventional free weights. This is because the weight (e.g., barbell or dumbbell(s)) that are attached to the device can be pushed out to the desired starting position with much less effort and in a safer manner than picking free weights up off the floor.

Beyond the above-mentioned benefits, embodiments of the present invention also have the potential to provide unique exercises that are advantageous in the field of athletic performance training as it allows athletes to train strength and power development in a more horizontal direction (versus vertical) and in those body positions and angles that are required by the particular sport. Many free weight exercises are vertical in nature. Recent research has shown that horizontally directed ground force production development may be more efficacious to improving athletic speed and sport's performance. However, there are limited ways to overload muscles in this direction using traditional free weights available on the market. Some fixed machines do offer a horizontal movement direction, but because they force the lifter into a predetermined movement pattern they do not engage the important stabilizing muscles of the body. Many machines also are designed as open chained movements (feet off the ground or sitting). Both of these negatives have an impact on developing strength that translates into increased power and speed. The stabilizing muscles play an important part in transferring and preventing leakage of energy that it is generated from the athlete putting force into the ground and then transferring it up through the body to execute the movement required by the athletic endeavor. In light of this, ground force (feet into the ground) development appears to be a critical component. Embodiments of the present invention allow for many exercises that are free, closed, and horizontal in nature which offers a new exercise class to be developed.

BRIEF DESCRIPTION OF THE DRAWINGS

The foregoing summary, as well as the following detailed description of preferred embodiments of the application, will be better understood when read in conjunction with the appended drawings wherein like reference numerals refer to like components. For the purposes of illustrating the system and method of the present application, there is shown in the drawings preferred embodiments. It should be understood, however, that the application is not limited to the precise arrangement, structures, features, embodiments, aspects, and systems shown, and the arrangements, structures, features, embodiments, aspects and systems shown may be used singularly or in combination with other arrangements, structures, features, embodiments, aspects and systems.

The drawings are not necessarily drawn to scale and are not in any way intended to limit the scope of this invention, but merely to illustrate embodiments of the invention. In the drawings.

DETAIL DESCRIPTION OF CERTAIN EMBODIMENTS

In accordance with various embodiments of the invention, and as shown herein, various systems and methods are disclosed which enhance a user's exercising experience using a unique and novel exercise device.

Embodiments of the present invention include a free-weight exercise swing attachment designed to be used with standard power racks and other supporting structures. Certain embodiments include one, two or more nylon tubular webbing free swing straps (or chains) having loops that are designed to be easily secured to a power rack with adjustable (releasable) steel pins or other attachment devices. Although described in terms of nylon it will be appreciated that other materials, such as rubber or rayon, for example, can be used. The webbing straps or chains serve as movable hinges that connect to barbells, dumbbells (e.g., in the case of a single strap), and other standard or non-standard free weight equipment and allow for numerous free-swinging weight lifting exercises to be performed.

Certain embodiments of the present invention include nylon utility handles and/or a padded belt **106*a*** that can connect to the weight load (e.g., barbell) via, for example, various nylon connector ropes or a foot plate that can connect to the weight load, in each case, that allows additional exercise movements to be performed. These exercises offer both a performance and economical advantage over current steel-based machine exercises and attachments.

Figure 1:
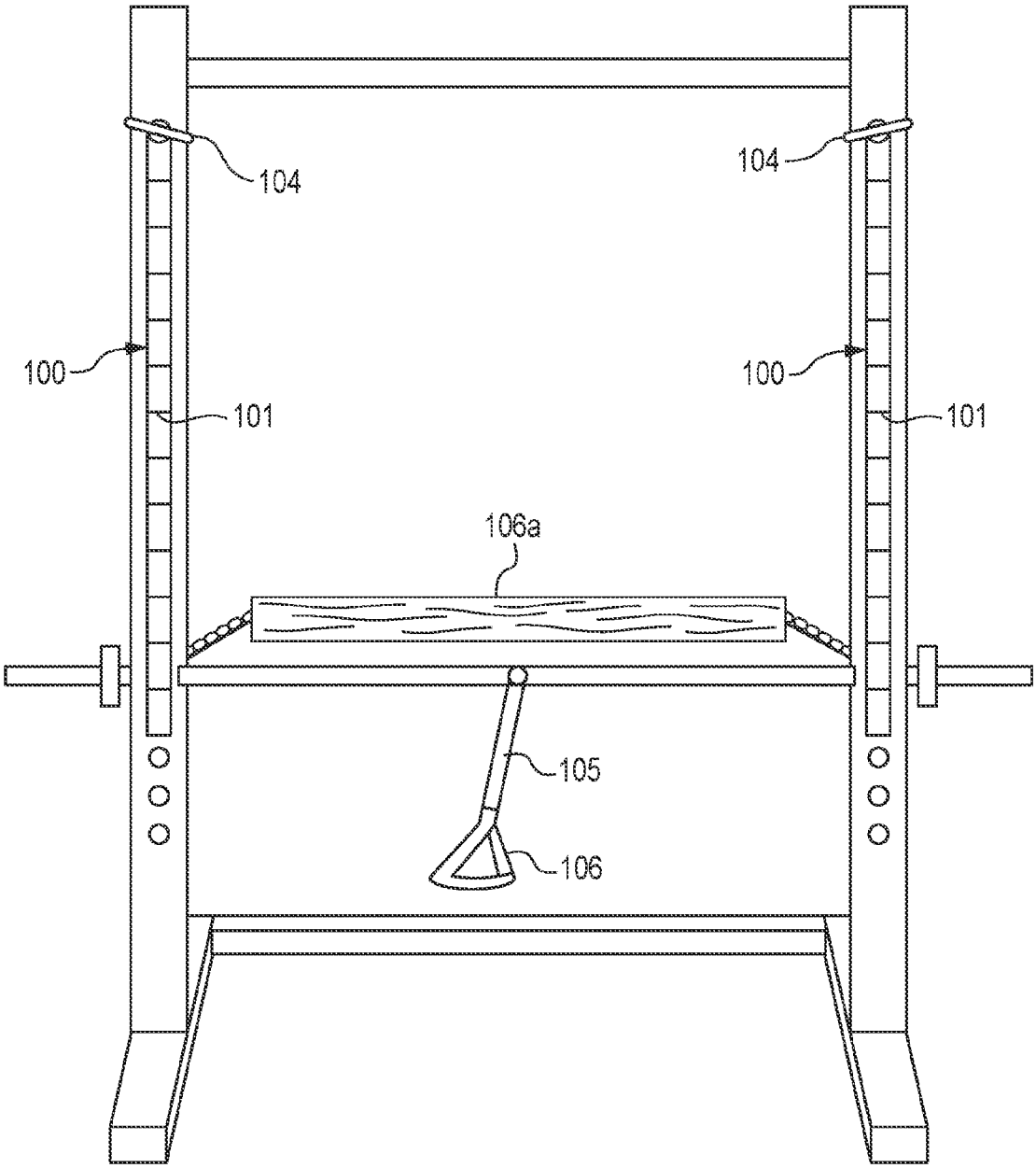
FIG. 1 is a perspective view of one embodiment of the present invention attached to a preexisting commercial power rack and to a commercial barbell.
Figure 2:
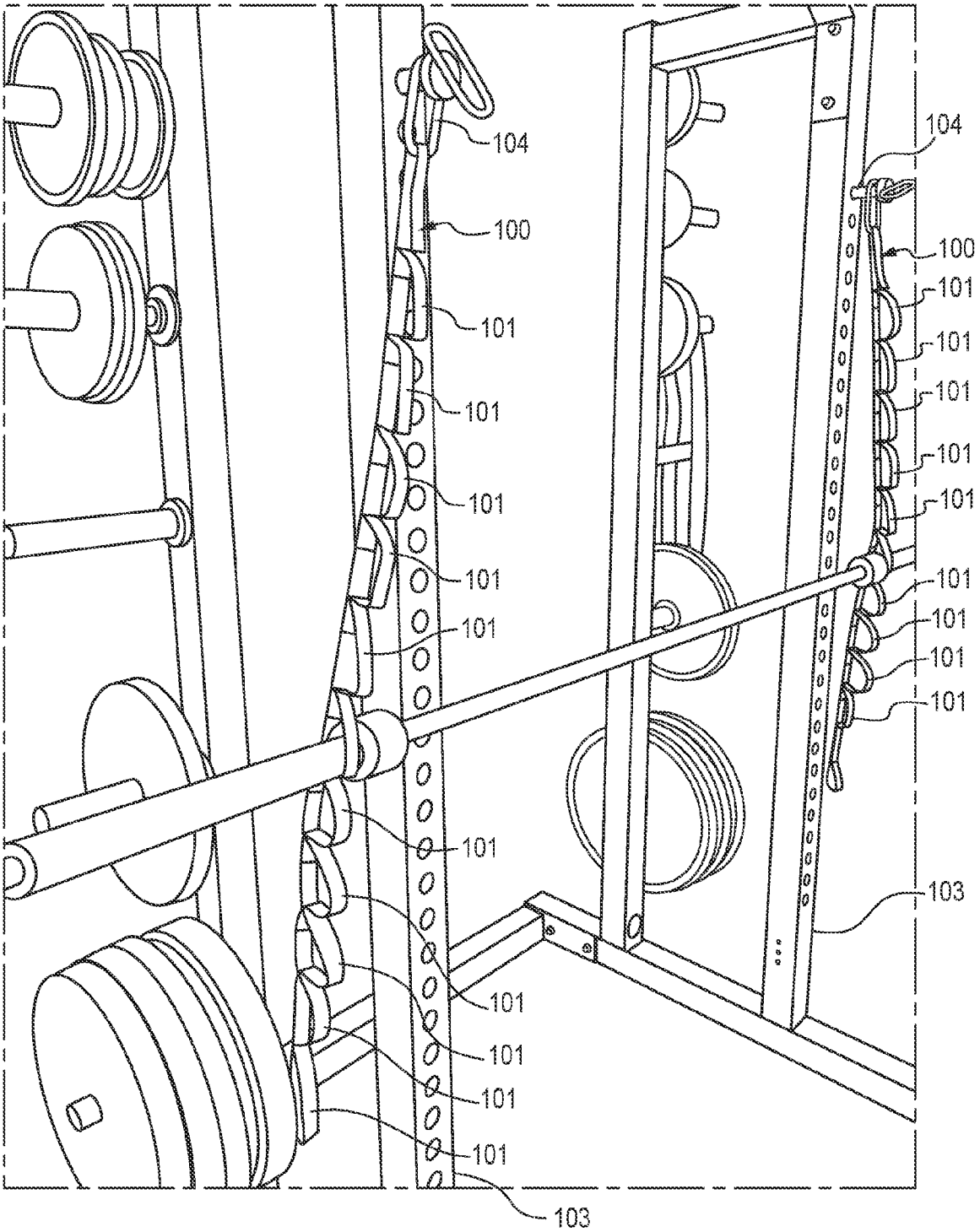
FIG. 2 is a perspective view of one embodiment of the present invention attached to a preexisting commercial power rack and to a commercial barbell.
Figure 3:
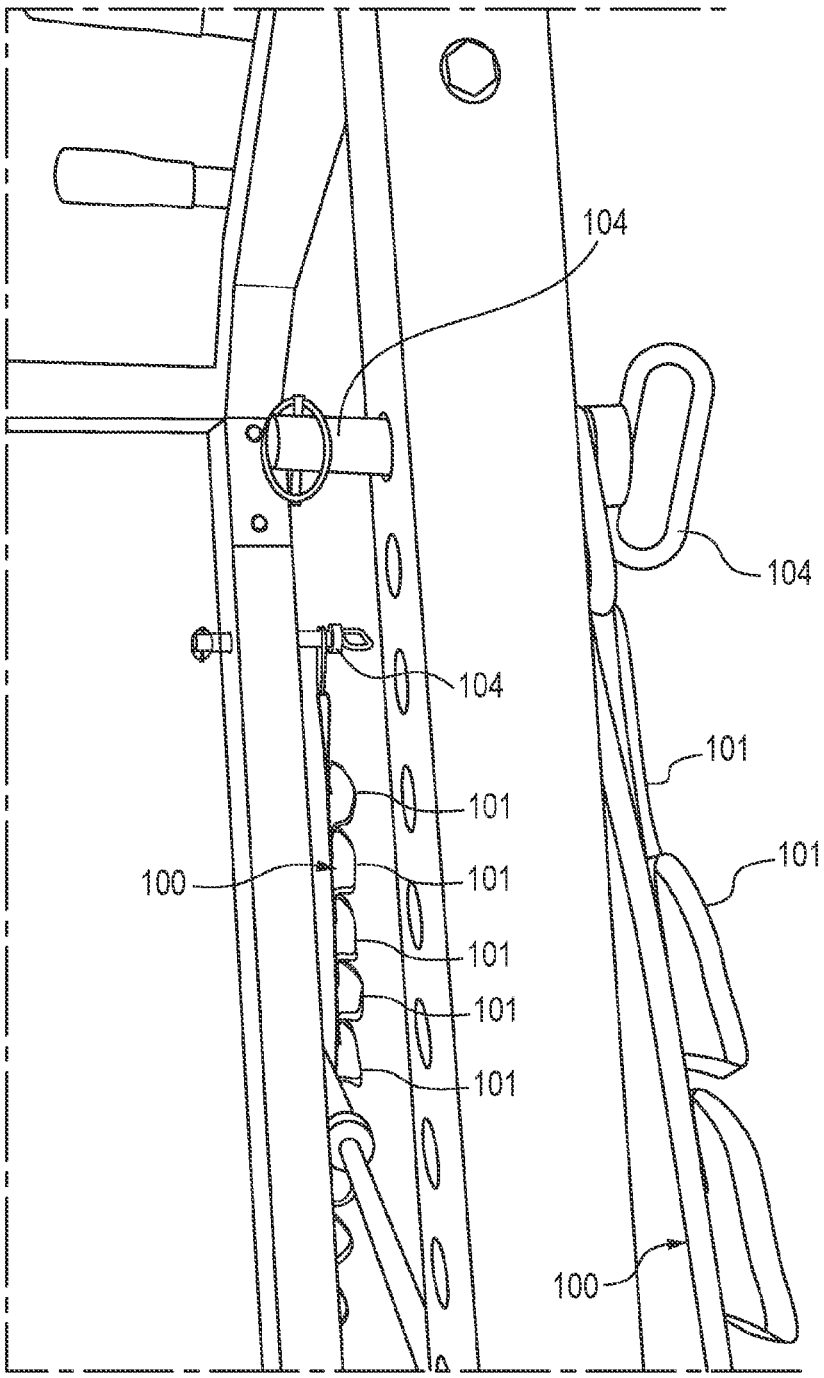
FIG. 3 is a close up perspective view of a pin according to one embodiment of the present invention attached to a preexisting commercial power rack.

As can be seen in FIGS. 1-3, a nylon tubular strap 100 having multiple attachment loops 101 is utilized to allow a user to perform various exercise routines and lift weights from a unique perspective. Loops 101, which can be of a variety of sizes, shapes, quantity and location(s) along the length of the strap (e.g., one at the end, multiple spaced apart, etc.) are preferably designed so as to hold commercial barbells and other standard or non-standard free weights. The loops 101 may also be moveable or adjustable to allow various weight loads to be used for numerous upper and lower body exercises as can be appreciated by one of ordinary skill in the art.

Figure 15:
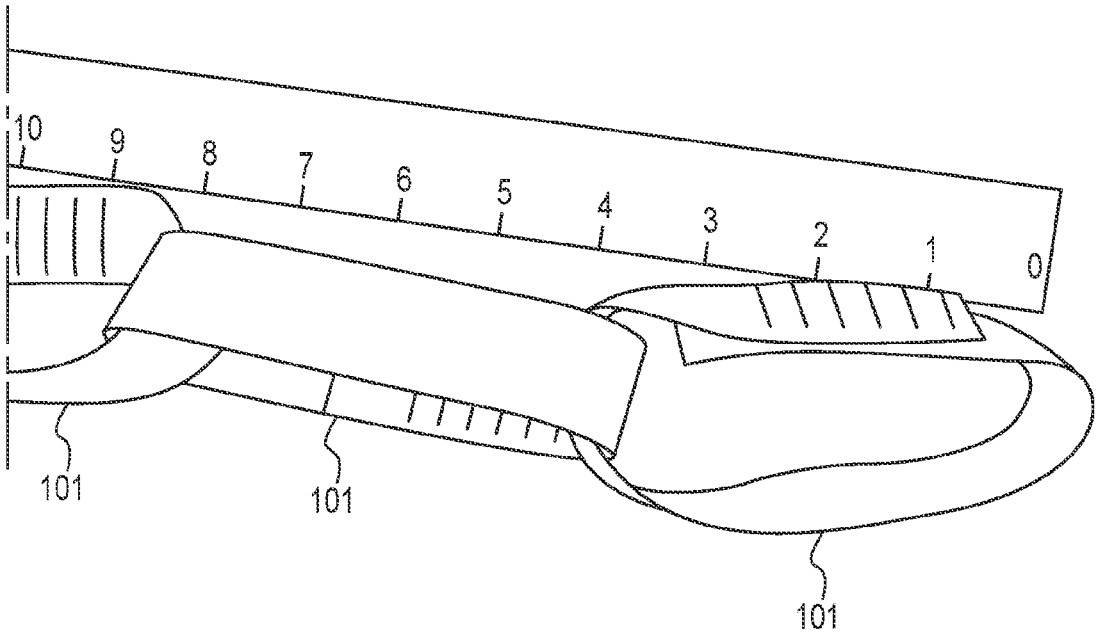
FIGS. 15-16 are close up views of loops and a strap according to one embodiment of the present invention.
Figure 16:
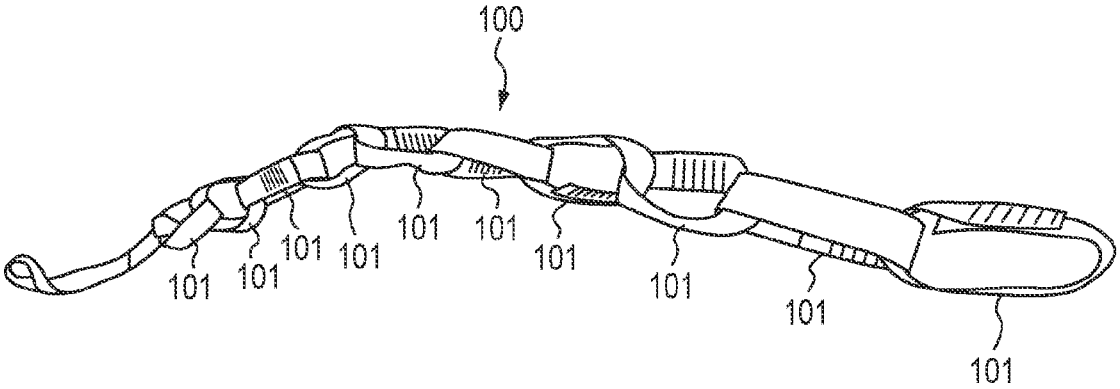

As can be seen more clearly in FIGS. 15 and 16, in a preferred embodiment, the strap 100 is formed by a series of interlocking (daisy-chained) loops 101, with each loop 101 between about 3 and 6 inches and most preferably about 4 inches long. This spacing allows for easier insertion of the weights and proper balancing that permits enhanced exercise positions, although other sizes may be used. In some embodiments, a strap may have different sized loops. The length of strap 100 can vary as can be appreciated by one of skill in the art. In a preferred embodiment the length is between about 48 and 72 inches and most preferably about 60 inches. This allows the proper distancing for an average user and the ability to perform multiple exercises across varying planes, although other lengths may be used. Straps and loops may be formed in other ways. For example, strap 100 may be formed upon a continuous strip of tubular nylon onto which pieces of nylon are stitched to create the loops, e.g., as in FIG. 2.

Figure 14:
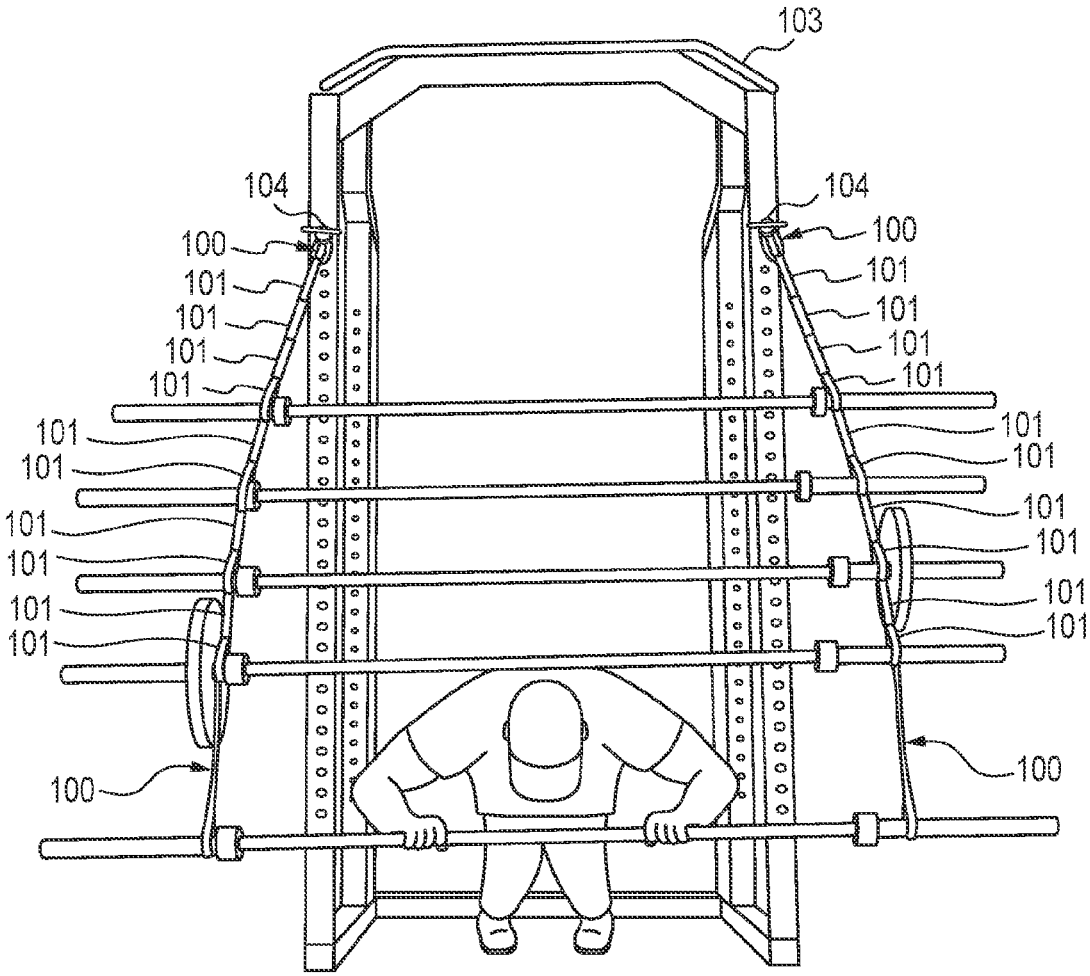
FIG. 14 is a view of one embodiment of the present invention utilizing multiple barbells.

In one embodiment, when utilized with a conventional barbell, two straps 100 are typically placed at a pre-arranged distance apart from each other so that a loop from each strap can hold or support each end of a barbell. Each strap 100 may be secured to a standing power rack 103 using a steel locking pin 104 (e.g., passing through one loop 101, a metal loop secured to strap 100, as shown in FIG. 2, etc.), which steel locking pin is of sufficient strength to maintain the fixed position of one end of the strap while at the same time supporting the necessary weight for the exercise. In different embodiments other locking mechanisms as are known in the art may be used as well together with or instead of locking pins 104. Utilizing strap 100 and power rack 103 allows the user to maintain the balance and stability that standing power racks provide while providing extra flexibility that is usually only found as part of a free weight. In one embodiment, additional nylon connector cords 105 that can attach to one or more nylon rope handles 106, and/or a belt **106*a* can be connected to the barbell so that the user can connect to the weight load at different exercising positions. As can be appreciated by one of ordinary skill in the art these positions can include standing, sitting, kneeling, and lunging and can take place at various distances from the load. In one embodiment as can be seen in FIG. 14, multiple weights can be removably inserted into loops 101**. This permits a more equal (or different) distribution of weight allowing the user to strengthen muscles and perform additional exercises.

Figure 11:
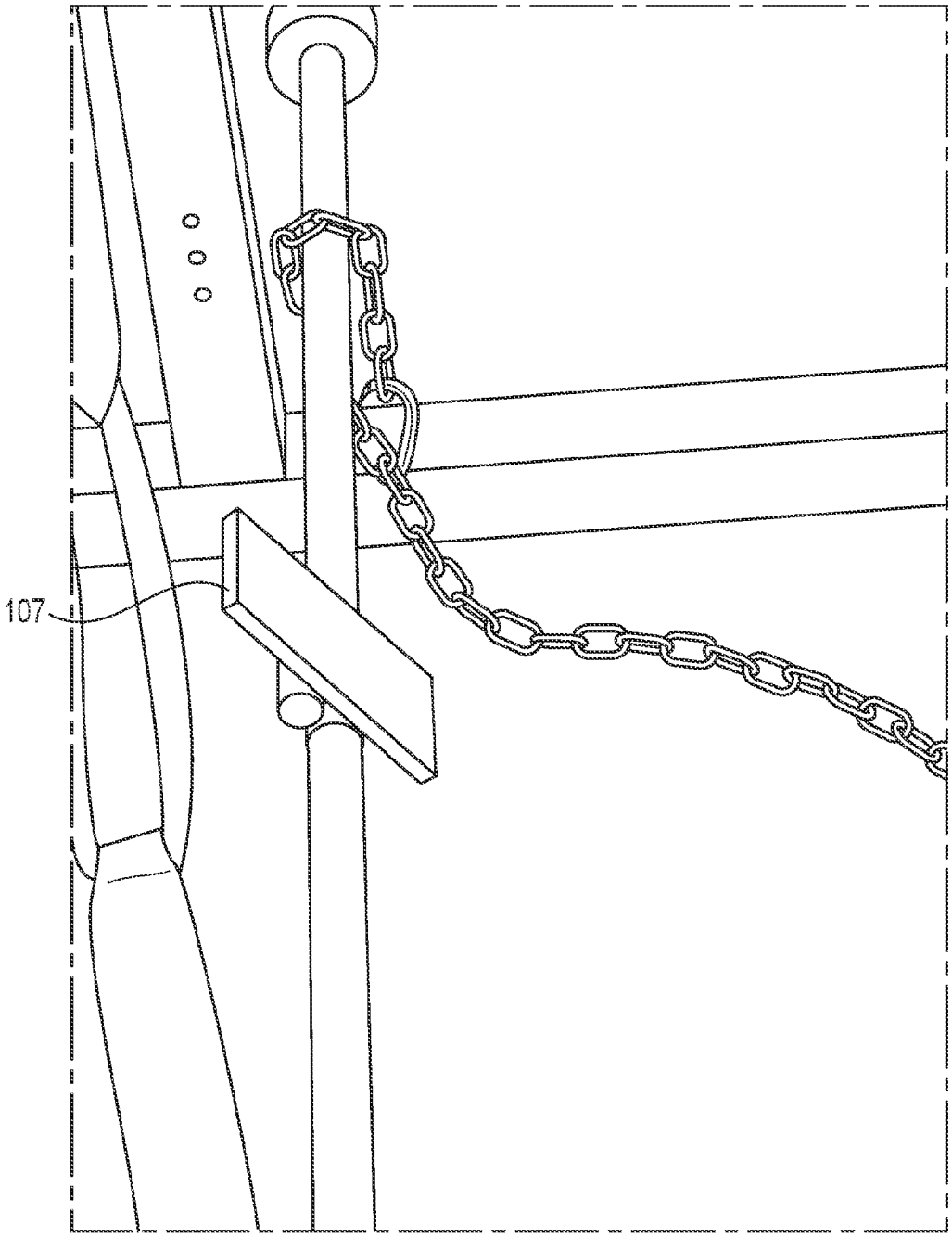
FIG. 11 is a perspective view of a modified barbell having a foot plate suitable for use with embodiments of the present invention.
Figure 12:
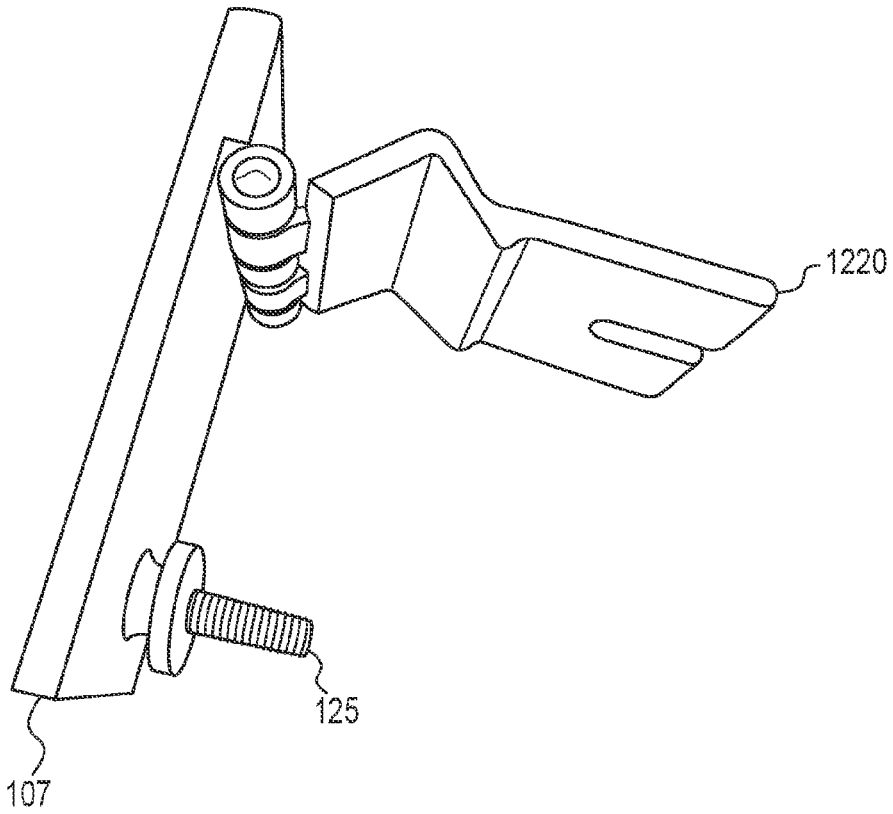
FIGS. 12-13 are close up views of a foot plate according to one embodiment of the present invention in an open position.
Figure 13:
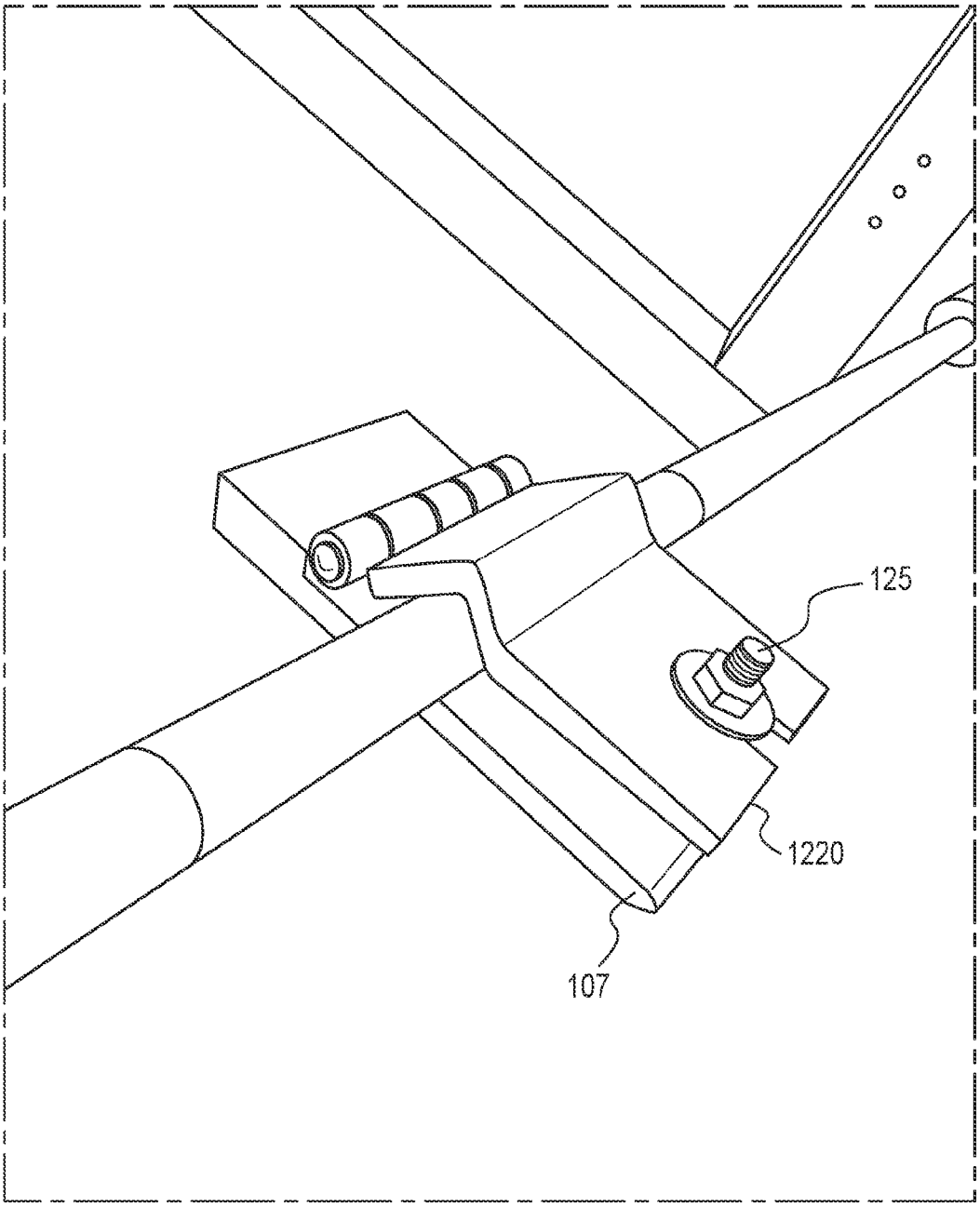

As can be seen in FIG. 11, foot plate 107 can be connected to a barbell or other weight load so that a user can utilize his or her foot to thrust off or otherwise push the weight. FIGS. 12 and 13 show foot plate 107 in an open position when disconnected from the weight. As can be seen in FIGS. 12 and 13, the rear portion of foot plate 107 comprises a latching and locking mechanism that allows the foot plate 107 to be secured to the barbell or other weight load. Latch 1220 is configured to latch onto screw 125 which can then be secured with a nut and bolt mechanism as shown in FIG. 13. As can be appreciated by one of ordinary skill in the art, additional or alternative locking mechanisms can be utilized to secure foot plate 107 to the barbell or other weight load. In some embodiments, foot plate 107 is weld or integrally formed with the barbell.

As can be seen in FIGS. 4-10, strap 100 (here, two) can be utilized in various exercise and weight lifting positions. As can be appreciated by one ordinary skill in the art, the below discussed exercise and weight lifting routines are mere examples, and according to varying embodiments of the present invention, other exercises can be envisioned and carried out without departing from the scope of the present invention.

Figure 4:
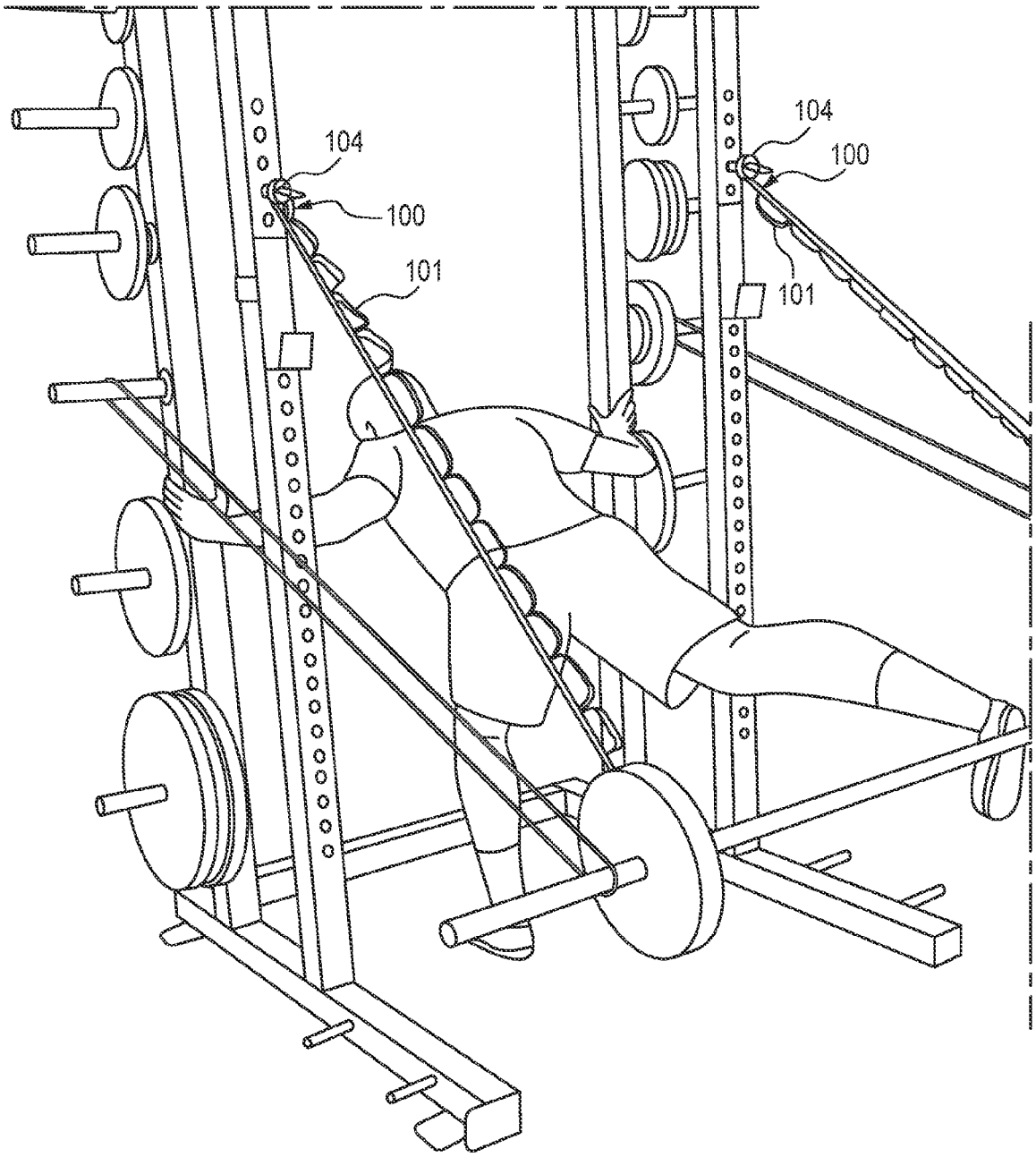
FIGS. 4-10 are perspective views of embodiments of the present invention being used in various exercises.

As can be seen in FIG. 4, a user can use his hands to stabilize his body against the power rack while leaning forward and raising the barbell by pushing it or on the foot plate that is attached to it. In this embodiment strap 100 and the loops 101 are utilized to allow the lower positioning of the weight while still being connected to the stable power rack. As shown, optional rubber bands connected between the rack and barbell may be used for resistance.

Figure 5:
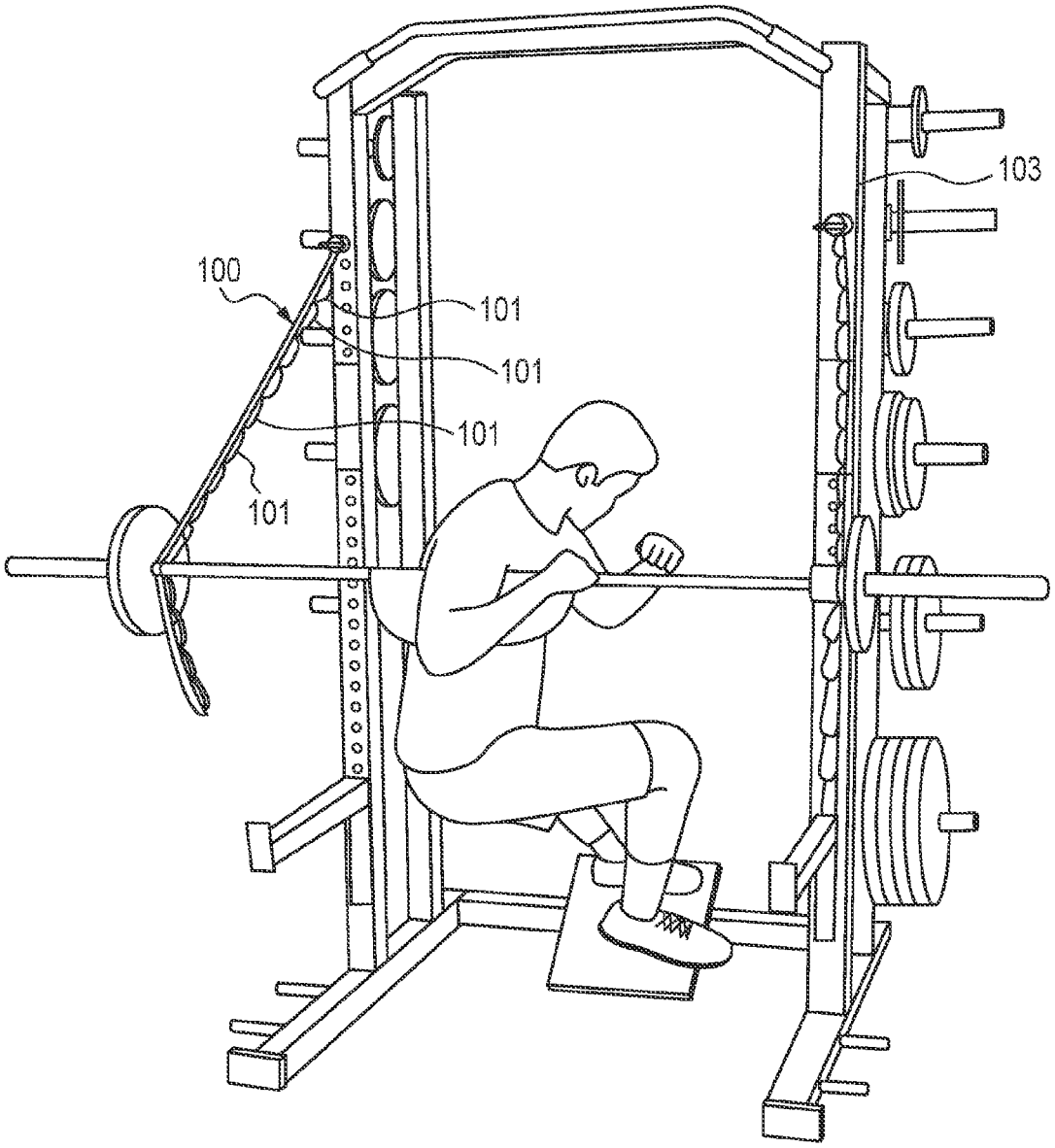

As can be seen in FIG. 5, a user can place the barbell weight under his arm while pushing off the power rack or (as shown) an angled plate on or near the floor. Strap 100 enables the mid-positioning of the weight to allow the user to exercise muscles employing a horizontal movement.

Figure 6:
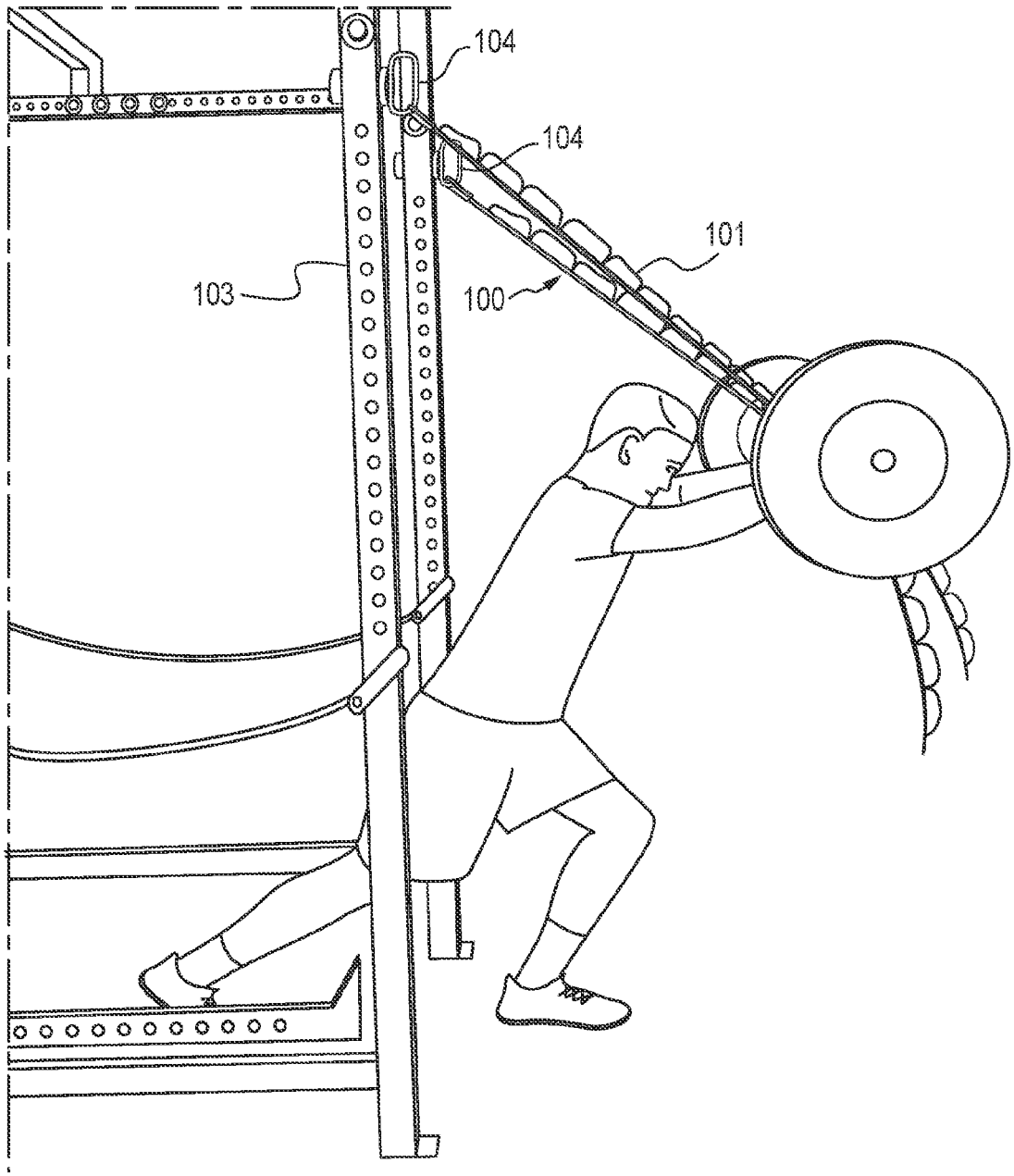
Figure 7:
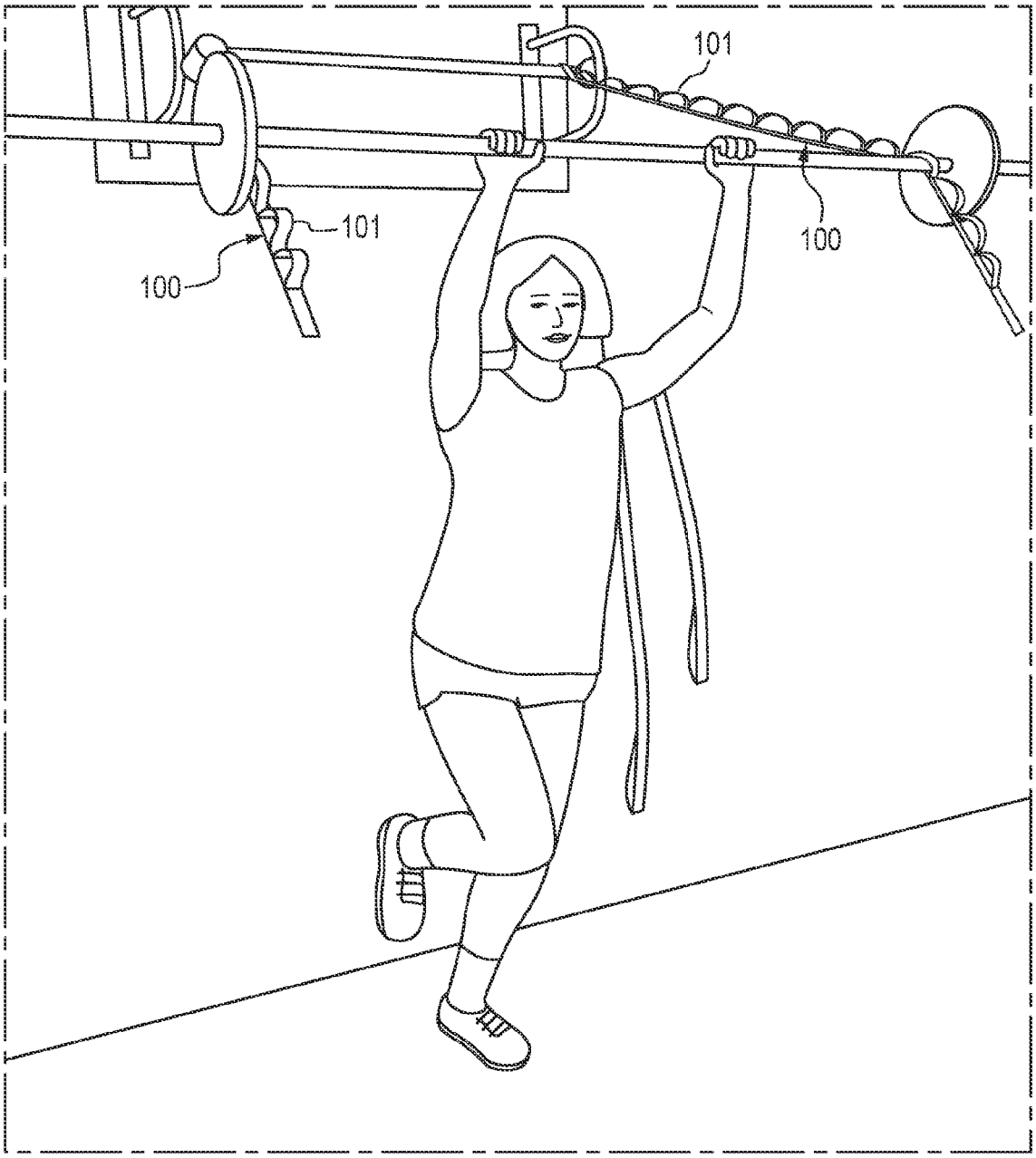

As can be seen in FIGS. 6 and 7, users can lunge with a weight supported by straps, for example, between a position above their head to a position that is parallel or below his face utilizing straps 100. Alternatively, they can pull on the weight without flexing in manner that strengthens their thigh and leg muscles. The flexibility and agility of straps 100 allows this positioning to enable increased positioning of the weights and flexing of muscles. As shown in FIG. 7, the straps 100 can alternately be secured to a chin-up bar.

Figure 8:
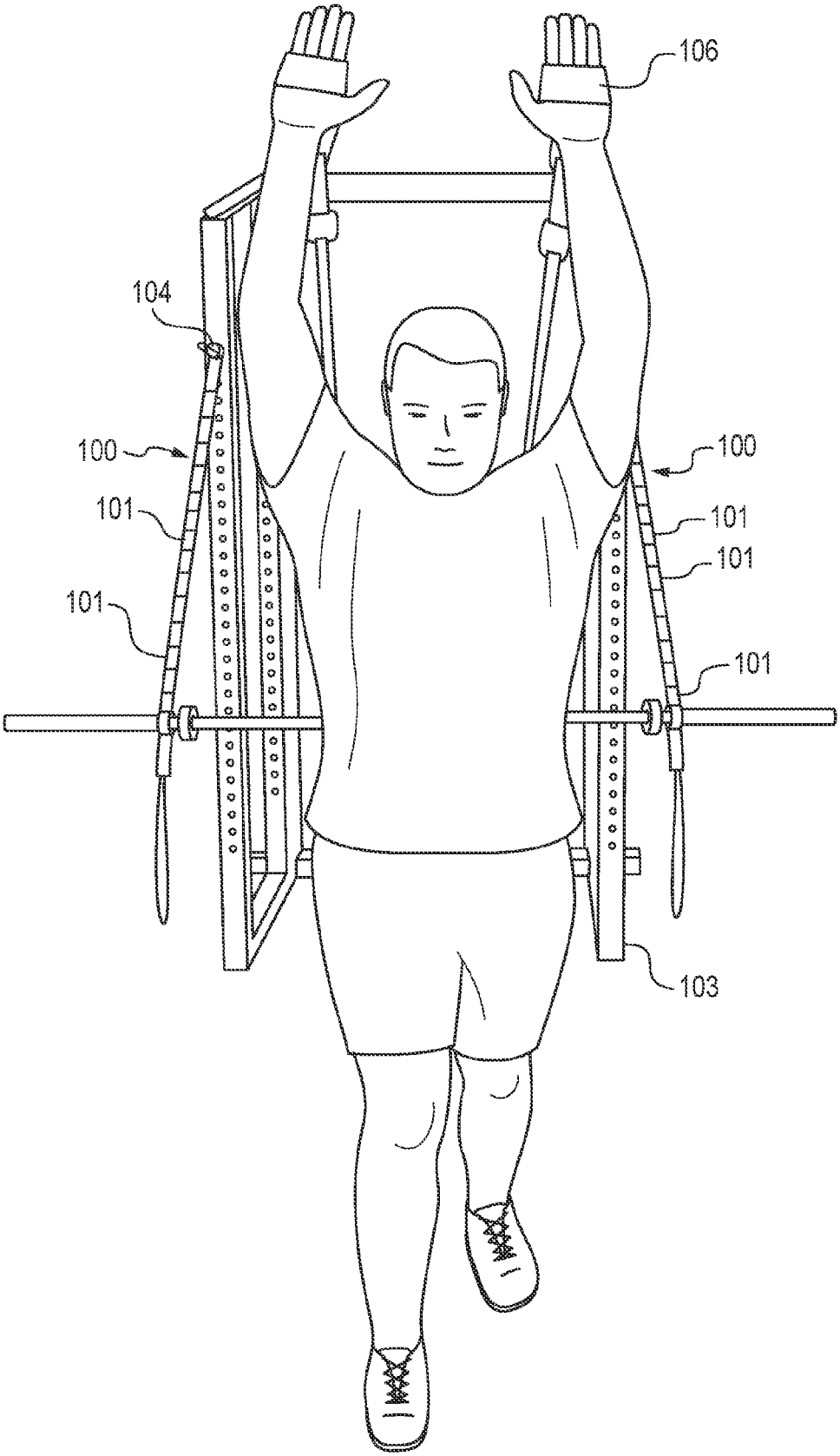

As can be seen in FIG. 8, two nylon rope handles 106 can be used by a user to pull weights from behind utilizing straps 100. Loops 101 allow the user to position the weights at various heights to accommodate the posture and build of various users. Alternatively, various weights can be placed within the various loops 101 to increase and vary the size and position of the weights.

Figure 9:
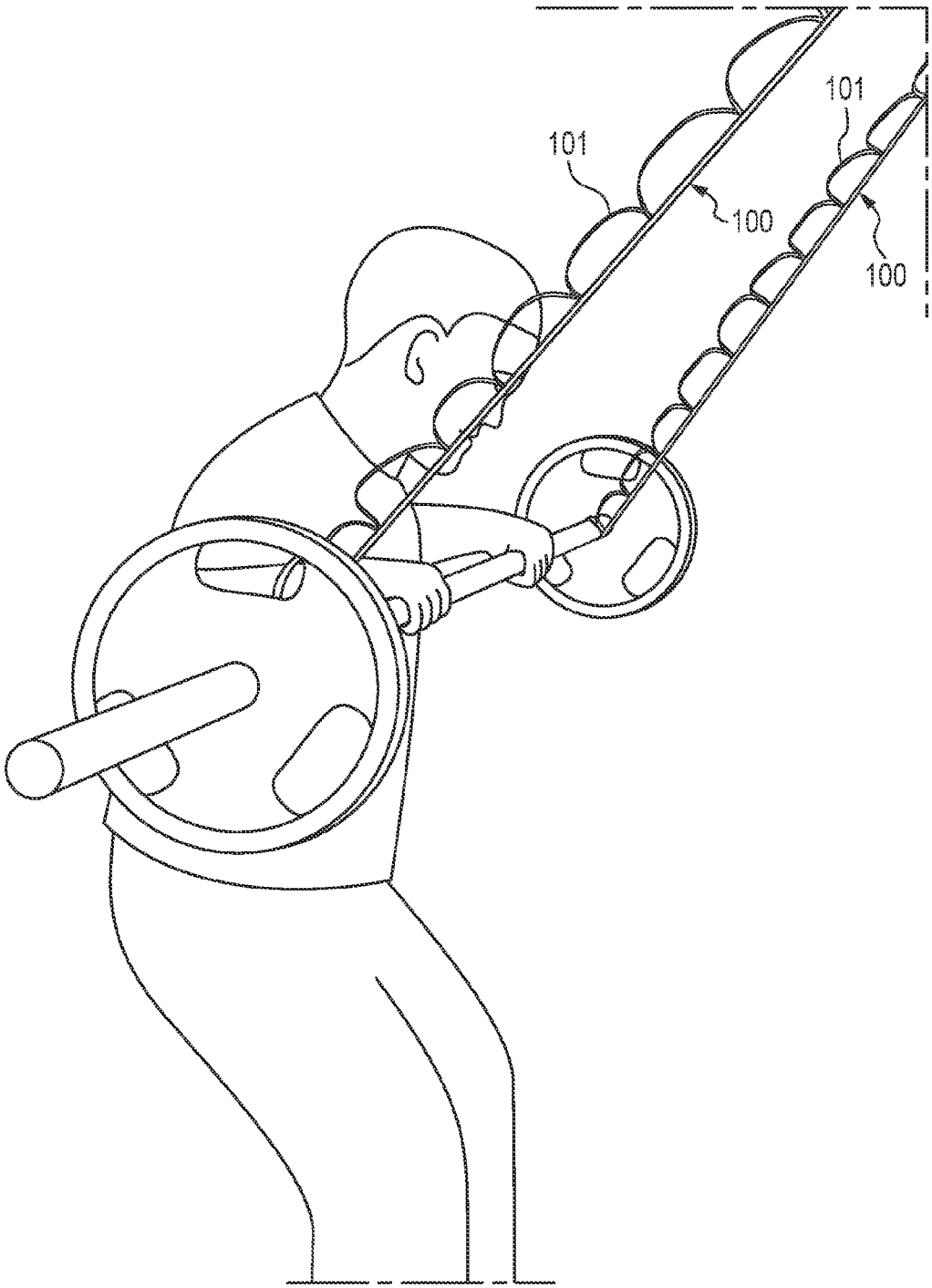

As can be seen in FIG. 9, straps 100 can be used by a front facing user to pull the weight opposite his or her upper body. As will be appreciated by those skilled in the art, changing the user's location relative to the point at which the straps 100 are secured to the equipment changes the angle of raising and lowering the weight and thus use of muscles. Raising and lowering the weight at the angle shown allows for additional bodybuilding which combines the benefit of structured and free-standing weights.

Figure 10:
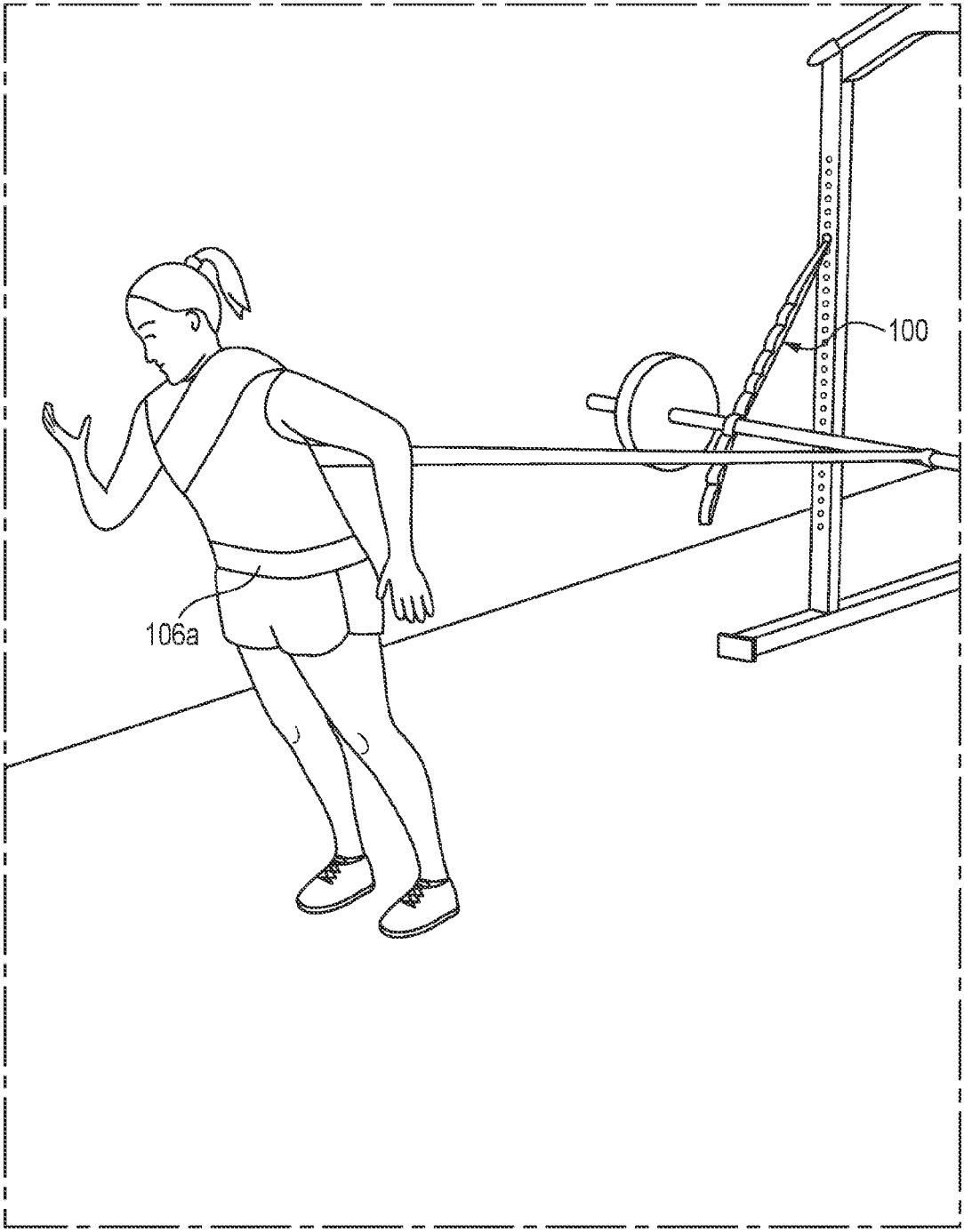

As can be seen in FIG. 10 in one embodiment, straps 100 can be attached to the back of a user utilizing a vest or other attachment mechanism (or, to the user's waist via a belt) so that the user can use her body to extend forward without using her hands or feet. Such a movement allows additional flexing of mid-body muscles without putting stress on the hands or feet.

It should be understood that those of ordinary skill in the art will recognize modifications and substitutions may be made to various elements of the present invention. For example, various features and/or elements have been described in connection with the preferred embodiments, which have not been described in another preferred embodiment. Various modifications of the invention in addition to those described herein will become apparent to those skilled in the art from the foregoing description and the accompanying figures. It is envisioned that these features and/or elements are interchangeable such that a feature or element described in one embodiment may be used in combination with another embodiment. Functionality may also be, in whole or in part, distributed among multiple components, in manners now known or to become known. It will be further appreciated by those skilled in the art that the figures are purely illustrative, and that the system may be implemented in any number of ways, as long as the functionality as described above, stays intact.

It should be noted that references herein to phrases such as "one embodiment" or "an embodiment" mean that a particular feature, structure or characteristic described in connection with the embodiment is included in at least one embodiment of the invention. The phrases such as "in one embodiment" or "in certain embodiments" in various places in the specification are not necessarily, but can be, referring to the same embodiment. Use of the term "preferred" or "preferably" is intended to indicate a configuration, set-up, feature, process, or alternative that may be perceived by the inventor(s) hereof, as of the filing date, to constitute the best, or at least a better, alternative to other such configurations, set-ups, features, processes, or alternatives. In no way shall the use of the term "preferred" or "preferably" be deemed to limit the scope of the claims hereof to any particular configuration, set-up, feature, process, or alternative.

Furthermore, it will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present description, including those of the provisional patent applications referred to herein. While there have been shown and described fundamental novel features of the invention as applied to the exemplary embodiments thereof, it will be understood that omissions and substitutions and changes in the form and details of the disclosed invention may be made by those skilled in the art without departing from the broad inventive concept thereof. It is understood, therefore, that this invention is not limited to the particular embodiments disclosed, but it is intended to cover modifications within the spirit and scope of the present invention. It is the intention, therefore, to be limited only as indicated by the scope of the claims appended hereto.

The invention claimed is:

1. A free weight attachment system for a user to perform free weight exercises in a horizontal direction, the free weight attachment system comprising:

a first flexible strap;

a second flexible strap;

a foot plate; and a belt or vest;

wherein each of the first flexible strap and the second flexible strap comprise a plurality of loops; a first end of the first flexible strap is configured to be secured to a first side support of a standing power rack using a first steel locking pin thereby forming a first moveable hinge and a first end of the second flexible strap is configured to be secured to a second side support of the standing power rack using a second steel locking pin thereby forming a second moveable hinge; the plurality of loops of the first flexible strap are configured to support a first side of a barbell and the plurality of loops of the second flexible strap are configured to support a second side of the barbell; a rear portion of the foot plate comprises a latching and locking mechanism comprising a hinged latch and a nut and bolt configured to secure the foot plate to the barbell so that the user is capable of pushing the barbell with their foot; and the belt or vest is configured to connect the barbell to the user's waist or back so that the user is capable of extending the barbell away from the standing power rack without using their hands or feet.

2. The free weight attachment system of claim 1, further comprising one or more utility handles configured to be connected to the barbell.

3. The free weight attachment system of claim 2, wherein the one or more utility handles comprise nylon rope.

4. The free weight attachment system of claim 2, further comprising one or more nylon connector cords configured to attach to the one or more utility handles and to connect to the barbell so that the user is capable of connecting to the barbell at different exercising positions.

5. The free weight attachment system of claim 1, wherein the first flexible strap and the second flexible strap comprise nylon.

6. The free weight attachment system of claim 1, further comprising one or more nylon connector cords configured to attach to the belt or vest and to connect to the barbell so that the user is capable of connecting to the barbell at different exercising positions.

7. The free weight attachment system of claim 1, wherein the belt or vest is padded.

8. The free weight attachment system of claim 1, wherein the plurality of loops of each of the first flexible strap and the second flexible strap comprises a series of interlocking loops.

* * * * *